US006082787A

United States Patent [19]

Chioffi et al.

[11] Patent Number: 6,082,787

[45] Date of Patent: Jul. 4, 2000

[54] LOCKING AND UNLOCKING DEVICE OF THE DOOR OF A DOMESTIC ELECTRICAL APPLIANCE

[75] Inventors: Mario Chioffi, Frosinone; Patrizio Rinaldi, Arnara, both of Italy

[73] Assignee: Bitron S.p.A., Nichelino, Italy

[21] Appl. No.: 09/218,496

[22] Filed: Dec. 22, 1998

[30] Foreign Application Priority Data

Dec. 22, 1997 [IT] Italy ..... TO97A1120

[51] Int. Cl.[7] ..... E05C 19/00

[52] U.S. Cl. ..... 292/128; 292/341.15; 292/150; 292/175; 292/DIG. 69

[58] Field of Search ..... 292/128, 80, 341.16, 292/341.15, DIG. 69, 150, 175, 179, DIG. 4

[56] References Cited

U.S. PATENT DOCUMENTS

| | | | |
|---|---|---|---|
| 3,546,410 | 12/1970 | Brighenti | 200/153 |
| 3,617,957 | 11/1971 | Brighenti | 337/77 |
| 3,892,933 | 7/1975 | Rocchitelli | 337/77 |
| 4,032,180 | 6/1977 | Pohl | 292/341.16 |
| 4,157,197 | 6/1979 | Wilson | 292/179 |
| 4,365,830 | 12/1982 | Paulson | 292/89 |
| 4,509,779 | 4/1985 | Sasaki | 292/254 |
| 4,620,735 | 11/1986 | Heydner | 292/144 |
| 4,687,236 | 8/1987 | Rasche | 292/16 |
| 4,932,707 | 6/1990 | Ekstran | 292/341.17 |
| 4,988,132 | 1/1991 | Rocchitelli | 292/144 |
| 5,323,628 | 6/1994 | Mori et al. | 68/12.26 |

FOREIGN PATENT DOCUMENTS

| | | | |
|---|---|---|---|
| 439849 | 8/1991 | European Pat. Off. | 292/341.16 |

*Primary Examiner*—B. Dayoan
*Assistant Examiner*—Clifford B Vaterlaus
*Attorney, Agent, or Firm*—Sughrue, Mion, Zinn, Macpeak & Seas, PLLC

[57] ABSTRACT

The device includes a housing having an aperture for the introduction of an engagement member fixed to the door, a retainer member mounted movably in the housing and movable between a working position in which it holds the engagement member when the door is closed and enables the domestic electrical appliance to operate, and a rest position in which it allows the engagement member to be released when the door is open and the engagement member to enter the aperture when the door is closed. An electromechanical control device includes a movable locking element movable under predetermined conditions, into a locking position in which it prevents the retainer member from moving from the working position to the rest position. The device further includes stop elements which lock the retainer in the rest position when the door is open, and release this retainer member when the door is closed.

6 Claims, 4 Drawing Sheets

LOCKING AND UNLOCKING DEVICE OF THE DOOR OF A DOMESTIC ELECTRICAL APPLIANCE

BACKGROUND OF THE INVENTION

The present invention concerns a device for locking the door of a domestic electrical appliance, such as the door of a front- or top-loading washing machine, or the door of a dishwashing machine.

More specifically, the object of the invention is a locking and unlocking device including:

- a housing having an aperture for the introduction of an engagement member fixed to the door;
- a retainer member mounted movably in the housing, which member is movable between a working position in which it retains the said engagement member when the door is closed and enables the domestic electrical appliance to operate, and a rest position in which it allows the said engagement member to be released when the door is opened and the engagement member to enter the said aperture when the door is closed; and
- an electromechanical control device comprising a movable locking member which is movable, under predetermined conditions, to a locking position in which it stops the aforesaid retainer member moving from the work position to the rest position.

In many domestic electrical appliances, safety standards require that the loading door of the appliance cannot be opened under certain conditions. For example, it must not be possible to open the loading door of a washing machine or a washer-dryer while the laundry-carrying drum is moving and/or when the level of water in the washing chamber exceeds a predetermined level.

In order to comply with these standards, door locking and unlocking devices of the type defined above are widely used, which include electrically controlled actuators such as solenoids or actuators having thermocouples and heating resistors. These safety devices prevent the door being opened during a washing cycle.

However, the currently available locking and unlocking devices cannot prevent the domestic electrical appliance from being started deliberately by the user while the door is open. In fact, in the case of a device of the type defined above, it is possible manually to move (possibly using an object or simple tool) the retainer member from the rest position to the working position while the door is open and, in these conditions, to start the appliance. This can obviously be dangerous.

The object of the present invention is to provide a locking and unlocking device for the door of a domestic electrical appliance, which makes it impossible, or at least extremely difficult, for such improper and, consequently, dangerous, use to occur.

This and other objects are achieved according to the invention by a locking and unlocking device for the door of a domestic electrical appliance including a housing with an aperture into which an engagement member mounted on the door is introduced, a retainer member mounted movably in the housing and movable between a working position in which it retains the engagement member when the door is closed and enables the domestic electrical appliance to operate, and a rest position in which it allows the engagement member to enter the aperture when the door is closed, an electromechanical control device including a movable locking element which is movable under predetermined conditions, to an obstruction position in which it stops the retainer member moving from the working position to the rest position, and stop means which lock the retainer member in the rest position when the door is open and which release the retainer member on closing the door.

BRIEF DESCRIPTION OF THE DRAWINGS

Further characteristics and advantages of the invention will become clear from the following detailed description, given purely by way of non-limitative example, with reference to the accompanying drawings, in which.

DETAILED DESCRIPTION OF THE INVENTION

Figure 1:
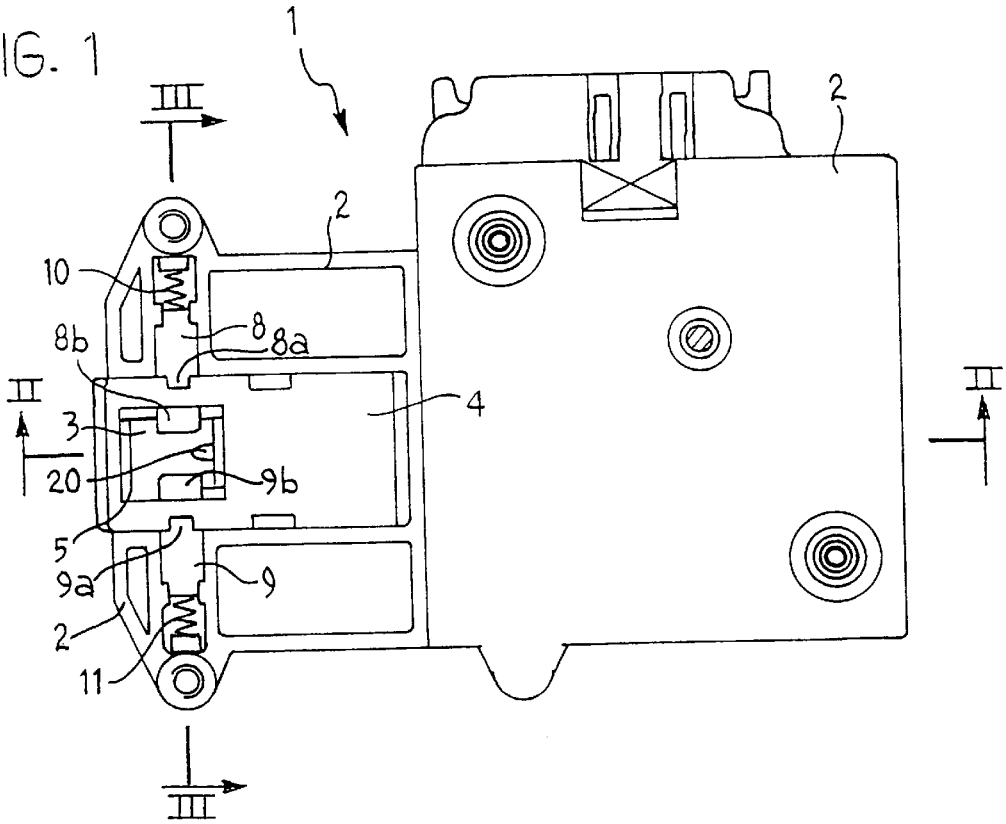
FIG. 1 is a rear view of a locking and unlocking device according to the invention.

In the drawings, the reference numeral 1 generally indicates a device according to the invention. This device includes a support housing 2 intended to be fixed to the structure S (FIG. 2) of a domestic electrical appliance, close to a loading or access opening O of the appliance, with which is associated a door P provided in known way with an engagement member A.

The housing 2 of the device 1 has an aperture 3 into which the engagement member A carried on the door is introduced.

Figure 2:
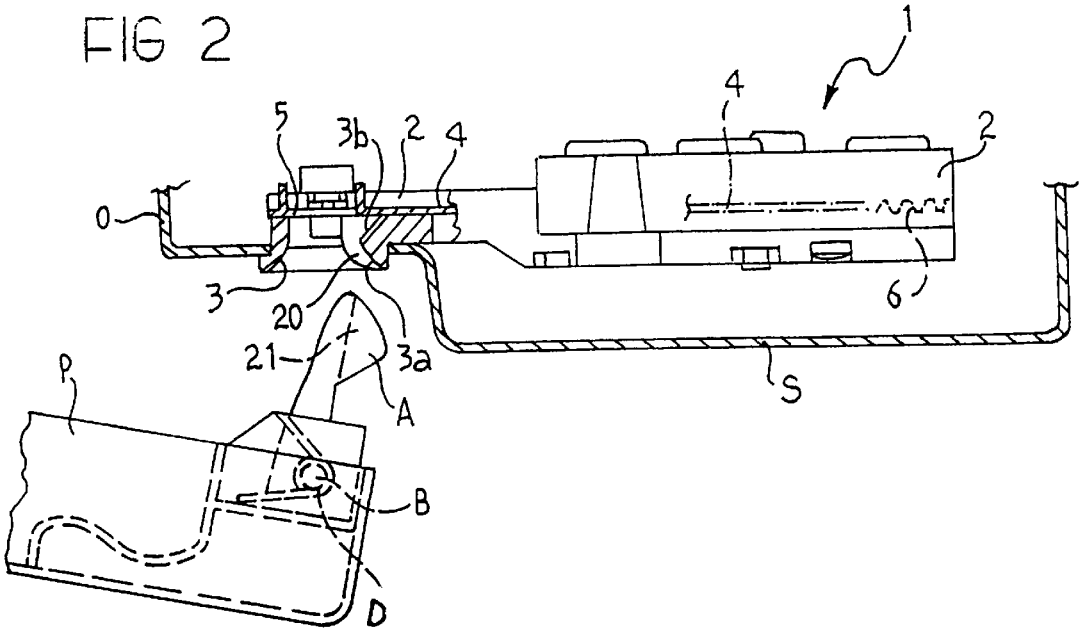
FIG. 2 a sectional view taken on the line II—II of FIG. 1, in which the door with the associated engagement member is partly shown.

As can be seen in particular in FIG. 2, in the example illustrated the engagement member A is rotatably connected to the door P about a pin B, and a safety spring D located about this pin holds the engagement member A in the position illustrated, preventing it from rotating (in an anticlockwise direction when looking at FIG. 2) with respect to the door.

A retainer member or slider 4 is slidingly mounted in the support housing 2 of the device 1, which element 4 has an aperture or window 5 through which the engagement member A passes.

When the door P is open, as shown in FIG. 2, the retainer member 4 is held (by an associated spring 6) in a rest position in which its window 5 faces the aperture 3 of the housing 2. In this condition, the engagement member A of the door can be introduced into the aperture 3 and the window 5 as the door is closed and, vice versa, can be released from this window and the said aperture as the door is opened.

In the embodiment illustrated (see FIG. 2 in particular), one vertical edge of the aperture 3 of the device is essentially dihedral in shape, with an inclined plane 3*a* facing the outside, and an inclined plane 3*b* facing the retainer member 4.

Figure 5:
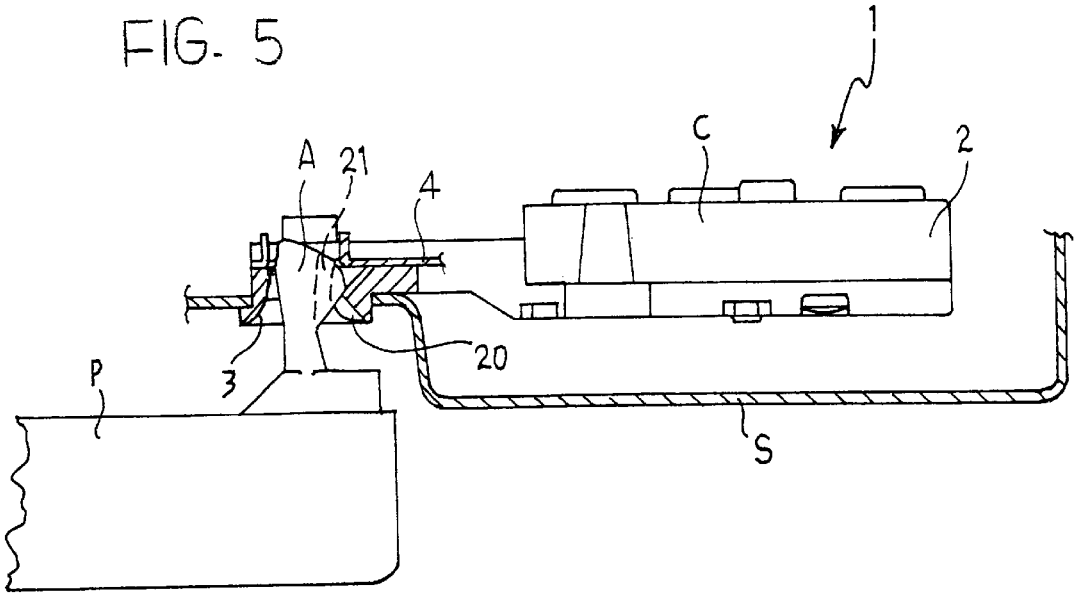
FIG. 5 is a sectional view taken on the line V—V of FIG. 4.

When the door P is closed, the engagement member A slides along the inclined plane 3*a* of the aperture 3 and, as the result of the interaction with this inclined plane, rotates slightly about the pin B (in an anticlockwise direction when looking at FIG. 2) against the action of the spring D until it rises above the corner formed by the inclined planes 3*a* and 3*b*. Upon lifting above this corner, the engagement member A is positioned as shown in FIG. 5, and its end starts to engage in the window 5 of the retainer member 4.

Once the closure movement is completed, the engagement member A, after having lifted above the aforesaid corner, further enters the window 5 of the retainer member 4, causing this latter to move towards the working position (shown in FIG. 8) against the action of the associated spring 6.

Figure 7:
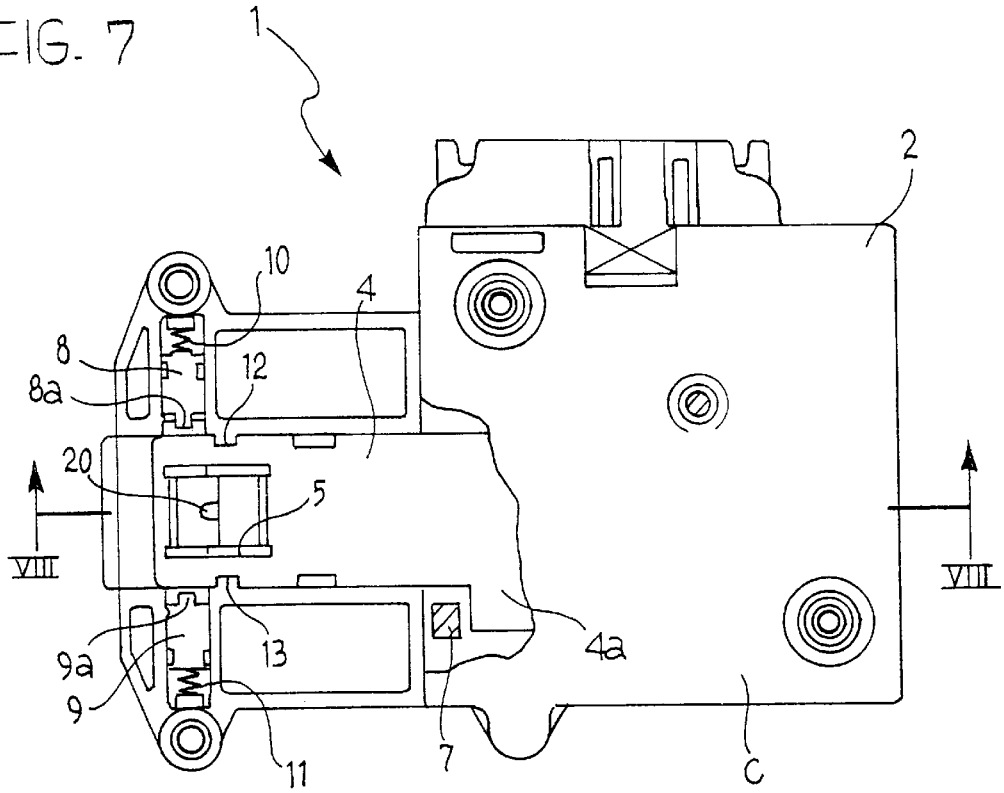
FIG. 7 is a similar view to FIGS. 1 and 4, and shows the device with the door closed.
Figure 8:
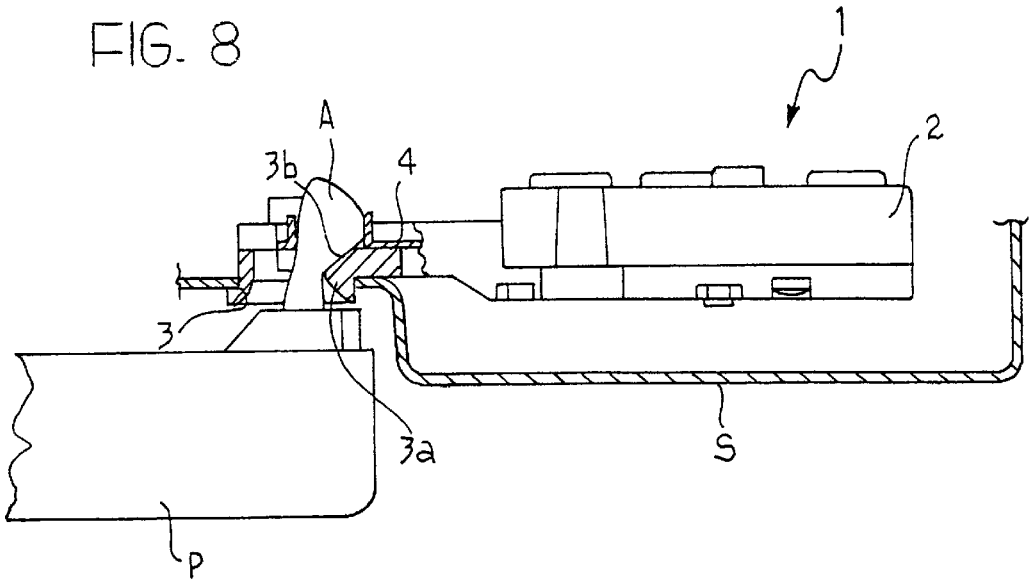
FIG. 8 is a sectional view taken on the line VIII—VIII of FIG. 7.

In the working position shown in FIGS. 7 and 8, the retainer member 4, together with a lateral sing 4*a* thereof (FIG. 7), passes beyond a stop element 7 which is mounted so that it is movable in a direction orthogonal to the member 4.

In a known way, the locking and unlocking device includes an electromechanical control device C which, under predetermined operating conditions, causes the stop element 7 to move to an extended position in which, by interfering with the wing 4*a* of the retainer member 4, it holds the retainer member in the working position of FIGS. 7 and 8. The movement of the stop element 7 towards this position can be controlled by the control unit of the electrical household appliance during the operating cycles thereof, during which the door P must be locked in the closed position.

In fact, the shape of the head of the engagement member A is such that when the slider or retainer member 4 is locked in the aforesaid working position (FIG. 8), the engagement member A remains held firmly between this retainer member and the corner formed by the inclined planes 3*a* and 3*b* of the aperture 3 of the housing.

At the end of an operating cycle of the electrical household appliance or, in general, during the stages of its cycle in which opening the door is not dangerous, the stop peg 7 is returned to an inactive position in which it does not interact with the wing 4*a* of the retainer member 4, thus enabling the retainer member 4 to return to the rest position (FIGS. 1 and 2) when the user desires to open the door.

Figure 3:
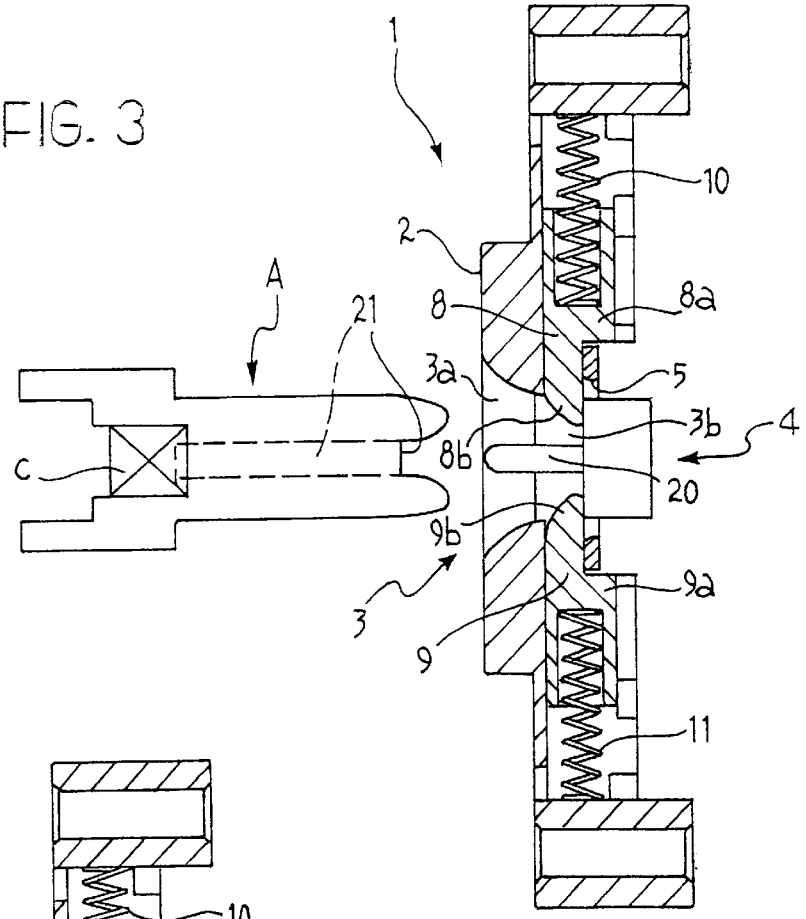
FIG. 3 is a sectional view on an enlarged scale taken on the line III—III of FIG. 1.
Figure 6:
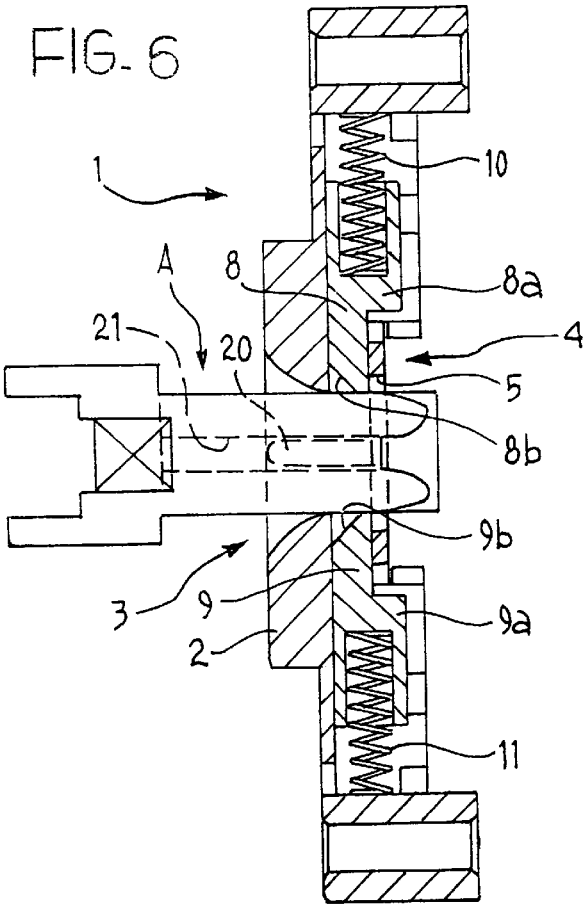
FIG. 6 is a sectional view taken on the line VI—VI of FIG. 4.
Figure 4:
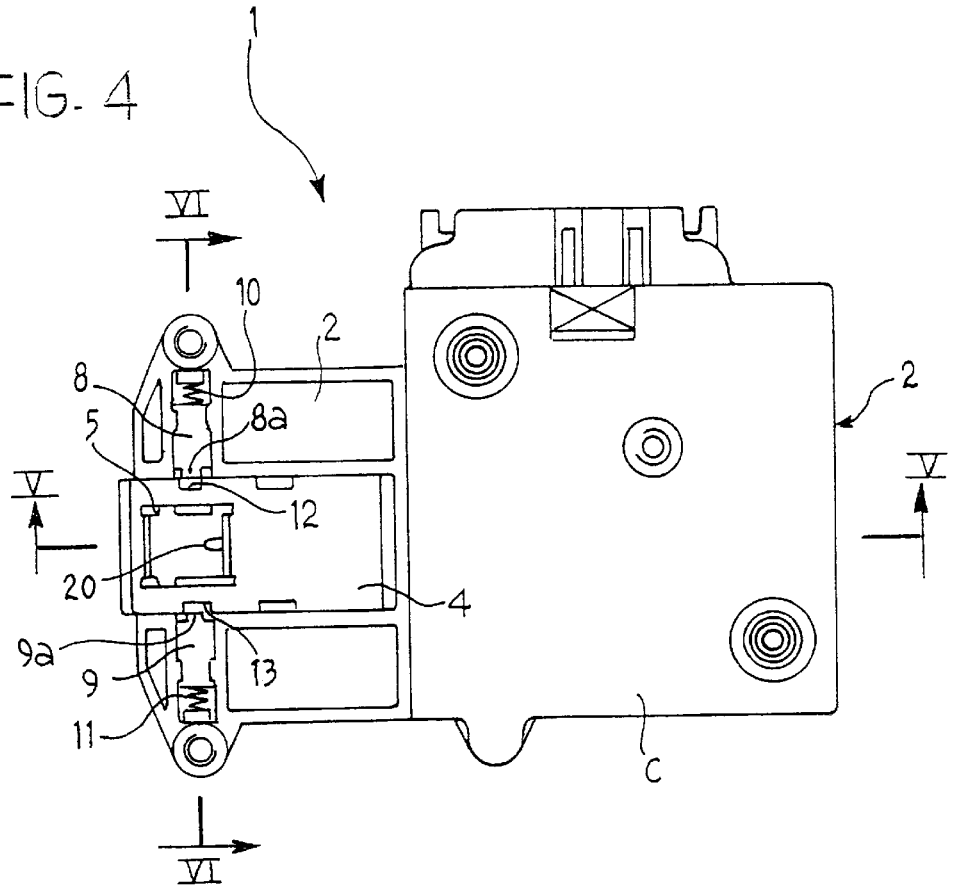
FIG. 4 is a similar view to FIG. 1 and shows the device in transition between the condition in which the door is open and that in which the door is closed.

As can be seen in FIGS. 3 and 6 in particular, upper and lower stop elements 8 and 9, respectively, are mounted in vertically translatable manner in the housing 2 of the device 1, close to the upper and lower sides of the appliance 3. Springs 10 and 11 respectively, are associated with these elements 8 and 9, and urge them towards each other.

As can be seen in FIG. 7 in particular, in correspondence with the window 5 the retainer member 4 has notches 12 and 13 in its upper and lower edges respectively.

Each stop element 8 and 9 has an associated locking projection 8*a* and 9*a*.

The arrangement is such that when the door P is open and the retainer member 4 is in the rest position (FIGS. 1 to 3), the notches 12 and 13 of the retainer member are aligned with the locking projections 8*a* and 9*a* of the elements 8 and 9. As the result of the thrust of the springs 10 and 11, the elements 8 and 9 are held in the locked position shown in FIG. 3, in which their projections 8*a* and 9*a* engage in the notches 12 and 13 of the retainer member 4, preventing this latter from leaving the rest position.

Conveniently, in the condition shown in FIG. 3, the elements 8 and 9 at least partially block the aperture 3 of the housing 2 of the device.

In the condition shown in FIG. 3 it is, at the very least, very difficult for the user to move the retainer member 4 from the rest position to the working position in which the domestic electrical appliance can be operated.

Conveniently, the end portions 8*b* and 9*b* of the elements 8 and 9 which, in the condition shown in FIGS. 1 to 3, face the aperture 3, are conveniently bevelled, so that these elements move apart from each other when, on closing the door P, the engagement member A interacts with them. As can be seen in FIGS. 6 and 7, introducing the engagement member A into and through the aperture 3 of the device 1 causes the mutual separation of the elements 8 and 9 against the action of the associated springs 10 and 11, and this leads to the projections 8*a* and 9*a* of these elements disengaging from the associated notches 12 and 13 of the retainer member 4. This latter is therefore free to move towards its work position, shown in FIGS. 7 and 8.

In the case of the device described above, each time that the door P is opened, the elements 8 and 9 move to the condition shown in FIG. 3 in which they lock the retainer member 4 in its rest position.

In this way, the object of the invention indicated in the introduction to the present description is achieved.

Conveniently, the side of the aperture 3 of the housing 2 that forms the inclined planes 3*a* and 3*b* has a projection 20 facing the opposite side of this aperture. Correspondingly, the head of the engagement member A has a lateral recess 21 which engages the said projection 20 when the door is closed. The purpose of the projection 20 is to make it even more difficult manually to move the retainer member or slider 4 from the rest position to the work position.

Naturally, with the principle of the invention remaining the same, the embodiments and the details of construction can be widely varied with respect to that described and illustrated purely by way of non-limitative example, without by this departing from the ambit of the invention as defined in the following claims.

What is claimed is:

1. A locking and unlocking device for the door of an domestic-electrical appliance, including:

a housing with an aperture into which an engagement member adapted to be mounted on the door is introduced;

a retainer member mounted movably in the housing and movable between a working position in which it retains said engagement member when the door is closed and enables the domestic electrical appliance to operate, and a rest position in which it allows said engagement member to be released when the door is opened and the engagement member to enter said aperture when the door is closed;

an electromechanical control device including a movable locking element which is movable, under predetermined conditions, to an obstruction position in which it stops said retainer member moving from the working position to the rest position; and stop means which lock the retainer member in the rest position when the door is open, and which release said retainer member on closing the door;

wherein said stop means comprises at least one stop element movable in said housing between a locked position in which it at least partially obstructs said aperture and holds the retainer member in the rest position, and an unlocked position in which it unblocks said aperture and allows said retainer member to move;

said stop element being shaped such that it can be held in the unlocked position as a result of the interaction with the engagement member when the door is closed.

2. A device according to claim 1, in which resilient means associated with the at least one stop element urge it towards the locked position.

3. A device according to claim 1, characterized in that the said stop means include two counterposed stop elements, movable in opposite directions from their locked positions to respective unlocked positions.

4. A device according claim 1, in which the said at least one stop element is movable in a direction at an angle, preferably a right angle, with respect to the direction of movement of the retainer member.

5. A device according to claim 1, in which the said at least one stop element has a projection which engages in a corresponding notch in the retainer member when this latter is in the rest position.

6. A device according to claim 1, in which the said aperture has a projection on one side and the engagement member has a corresponding recess which engages the said projection when the door is closed to the working position.

* * * * *